United States Patent [19]

Prevot

[11] 3,955,392

[45] May 11, 1976

[54] DEVICE FOR CHANGING MANDRELS IN TUBE ROLLING MILLS

[75] Inventor: Maurice Prevot, Aymeries, France

[73] Assignee: Vallourec Usines a Tubes de Lorraine-Escaut et Vallourec Reunies, Paris, France

[22] Filed: Jan. 6, 1975

[21] Appl. No.: 538,934

[30] Foreign Application Priority Data

Jan. 10, 1974 France ..... 74.538934

[52] U.S. Cl. ..... 72/209

[51] Int. Cl.[2] ..... B21B 25/06

[58] Field of Search ..... 72/209, 250, 251, 208, 72/201

[56] References Cited

UNITED STATES PATENTS

| | | | |
|---|---|---|---|
| 1,931,571 | 10/1933 | Burns | 72/201 |
| 2,771,800 | 11/1956 | Kritscher | 72/209 X |
| 3,277,687 | 10/1966 | Kelly | 72/209 |
| 3,382,798 | 1/1975 | Franceschina et al. | 72/209 |
| 3,762,201 | 10/1973 | Schonfeld | 72/209 |

*Primary Examiner*—Milton S. Mehr

*Attorney, Agent, or Firm*—Brisebois & Kruger

[57] ABSTRACT

Tube rolling mill of the STIEFEL type comprises a feed trough and a member between the trough and mill rolls over which the tube and plug pass. This member is movable between a first position in which it supports the tube and plug in alignment with the feed trough and a second in which it directs the plug into a discharge chute.

8 Claims, 6 Drawing Figures

DEVICE FOR CHANGING MANDRELS IN TUBE ROLLING MILLS

SUMMARY OF THE INVENTION

This invention relates to a device for mechanically changing mandrels in plug rolling mills. The invention is particularly applicable for changing plugs in plug rolling mills of the STIEFEL type.

The problem posed by the changing of the plugs in plug rolling mills is well known. These changes must generally be made in order to replace a worn plug or, in the case of installations through which several passes are made, in order to provide plugs appropriate to the different passes.

This problem has heretofore been met by manually mounting and removing the plugs which, in the case of STIEFEL mills, are simply located by the operators in a feed trough for running in the tubular member and then lifted into position by hand. It follows that such a manual process is not well adapted to the operating cycles of modern rolling mills and becomes more and more impractical as the size and weight of the plugs increases, as is the case when rolling tubular members of large diameter. It has already been suggested to substitute for the process of manual replacement a mechanical process utilizing an extractor which, in a descending movement, locates a plug in the feed trough for the rolling mill and, in an opposite movement, removes the plug after the pass.

This device is, however, cumbersome, not very practical, and inoperable when the operating cycle is speeded up.

It is for this reason that such devices have been replaced by a device using a small cylinder such as the one described in French Pat. No. 1,564,381, filed May 17, 1968.

This device comprises a frusto-conical cylinder having an inclined axis and provided with grooves for receiving plugs which grooves come sequentially into alignment with the feed trough for the rolling mill. A plug then in the feed trough is then carried forward by a tube which travels in the feed means until it reaches the rolls where it is axially blocked by the plug bar. At the end of the pass the plug, which was radially retained inside the tube being rolled, falls through an opening in the bottom of the feed trough at the level of the rolls into an inclined chute which returns it to the lower part of the barrel, which returns it to be recycled.

Because the tube travelling through the feed trough must carry the plug and bring it forward to the plug bar, the plug must itself have a shape permitting this operation.

To this end, the plug has a front part adapted to enter the tube being rolled so that the axis of the plug is exactly positioned and the plug is so held as to permit it to pass over the opening in the bottom of the feed trough without falling directly into the mouth of the discharge chute.

Experience has shown that this operation is easily provided for in the case of plugs corresponding to tubes of small diameter but when the weight of the plug increases and the mouth of the discharge chute elongates as a consequence, it is more and more difficult for the tube to hold the plug in line when it passes over this mouth.

Poor positioning of the plug results, on the one hand, in temporary halting of the operation in order to correct the accident, and also causes defects in the rolls because of the shocks imparted by the plug to the rolls.

It follows that the device does not provide satisfactory means for changing very heavy plugs, which may weigh several hundred kilograms.

The present invention proposes to overcome these disadvantages and to provide a device which, by insuring perfect guiding of the plug in the immediate proximity of the rolls, avoids any inaccurate positioning of the plug and the shocks and stoppages which result therefrom, and which also preferably avoids the abrupt falling of the plug onto the means for removing the plug at the end of the pass.

It is accordingly an object of the invention to provide a mechanical device for changing the plugs in tube rolling mills comprising:

a feed trough for the tubular members to be rolled positioned in alignment with the rolling axis and the end of which adjacent the rolls is spaced therefrom by a distance greater than the length of a plug, means for periodically moving a plug forward at the beginning of a pass in alignment with the rolling axis so that the plug is brought into abutment against the plug bar by the tube which travels through the feed trough, means for moving said plug away from the rolling mill axis at the end of each pass, characterized by the fact that it comprises movable guide means at the end of the feeding trough, which is movable between a first position aligned with the axis along which the tube is fed to the rolls of the rolling mill, and a second position spaced from said axis.

In the first position the guide means leaves the plug which has been pushed into the immediate proximity of the rolls by the tubular member to be rolled until it comes into abutment against the plug bar. After passage of the tubular member the guide means moves away, permitting the plug to fall away from the rolling axis and drop into the discharge chute to be recycled or eliminated.

In a first embodiment of the invention the guide means comprises a pair of trap doors defining a substantially V-shaped channel transverse to the axis of the rolls, which doors are, in their first position, aligned with the axis of the feed means, whereas the two trap doors move away from the feed means axis in a movement such as rotation or translation to reach a second position in which the plug may be removed.

In a second embodiment of the invention the guide means may comprise means permitting the plug to be moved away under the feed means away from the rollers, possibly after a first descending movement intended, by slightly lowering the level of the guide means, to permit its axial movement beneath the feed means.

In a third embodiment of the invention the guide means may comprise a guide member which is preferably tapered on the side of the rollers and so mounted as to pivot when descending with or without a specific geometric axis.

In this case the plug, which rests on the guide member, is evacuated when the latter is progressively inclined.

In the three embodiments of the invention it is advantageously possible to provide on opposite sides of the guide means fixed lateral walls which extend the lateral edges of the feed means to the immediate proximity of the rolls.

In a fourth embodiment the guide means comprises a horizontal member which is preferably V-shaped and mounted to be so displaced that it occupies a horizontal position to continue to directly support the plug. In this embodiment, several guide members may advantageously be provided which are capable of being alternately positioned in a first position aligned with the feed means, a plug of particular dimension being adapted to each of said devices. In the first three embodiments movement of the guide means toward its second position causes the plug to fall in response to gravitational force, thus permitting the removal of the plug by suitable means.

However, especially in the first and third embodiments of the invention, it is possible to provide for movement of the plug removing means such that the fall of the plug is reduced or restrained so as to avoid shocks and risks of damge to the mandrels.

In a preferred embodiment of the invention, the means for introducing the plugs to the machine comprises a barrel of the type shown for example in French Pat. No. 1,564,381, which barrel is located at a certain distance from the rolls and successively brings the plugs into axial alignment with the path of travel of the tubing through the mill and recovers the plugs from an inclined chute when the movement of the guide member to its second position permits the plug to fall into the chute after the pass. The arrangement thus provided preferably includes a guide member according to one of the three first embodiments above described and preferably according to the first.

However, in another embodiment, the means for introducing the plug incorporates guide means such as the horizontal guide member or members provided in the first embodiment of the invention, the barrel being then eliminated.

Other advantages and characteristics of the invention will appear from a reading of the following description, given purely by way of illustration and example, several embodiments of the invention, with reference to the accompanying drawings in which.

Figure 1:
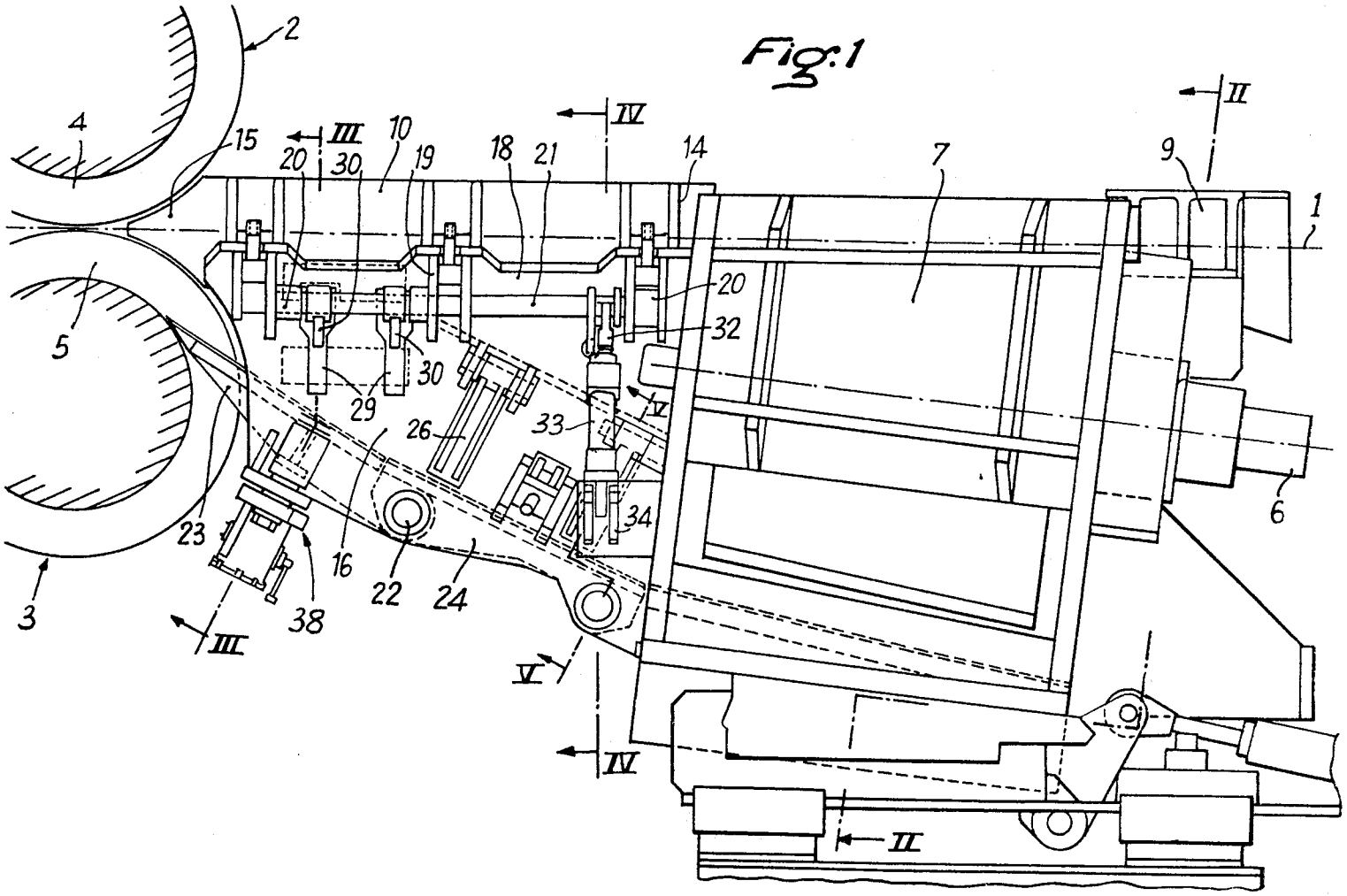
FIG. 1 is an elevational view of a device according to the invention.

Referring now to FIGS. 1–5 the device according to the invention is positioned immediately upstream of the rollers 2 and 3 of a STIEFEL mill, the other parts of which are not shown.

These FIGS. show the horizontal rolling axis 1 which passes through the grooves 4 and 5 of the rolls 2 and 3. A barrel of the type described in French Pat. No. 1,564,381 is rotatably mounted about an inclined axis 6 inside a casing 7. The barrel is rotated at each step for one quarter of a turn by means comprising a fluid pressure jack 8 with corresponding return means.

Figure 2:
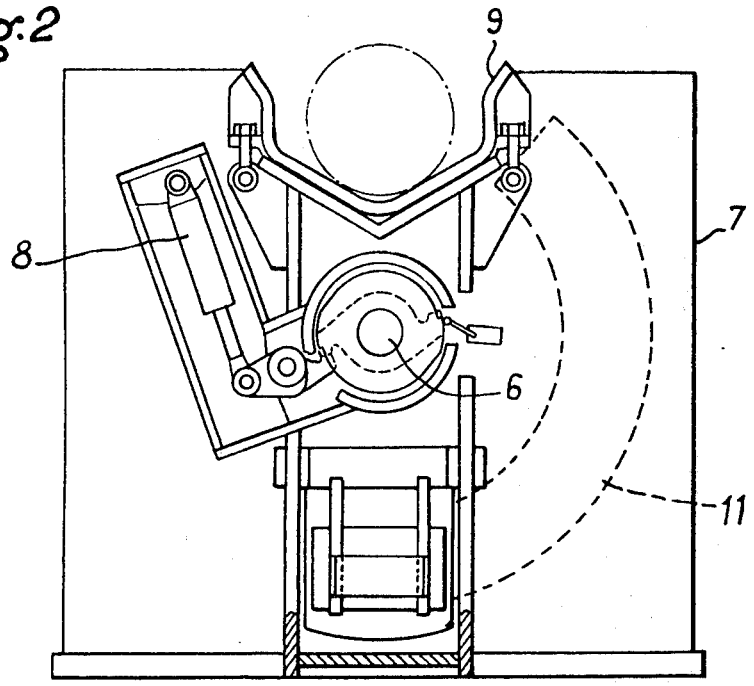
FIG. 2 is a sectional view taken along the ling II—II of FIG. 1.

As is well known the barrel comprises four grooves, the transverse section of which is shown in FIG. 2. The upper part of the device defines a horizontal feed trough having a V-shape the rear part 9 of which and the front part 10 of which are separated along the upper part of the barrel. Four grooves of the barrel have in transverse section a shape corresponding exactly to the shape of a transverse section of the two parts 9 and 10 of the feed channel. Because the grooves in the barrel are open on the periphery of the barrel, a frusto-conical frame member is provided, the shape of which is seen at 11, and which extends substantially from the lower part of the barrel to the upper part to prevent the plugs from falling out of the barrel.

The barrel and its accessories are of a type known in itself and will therefore not be described in further detail.

Figure 3:
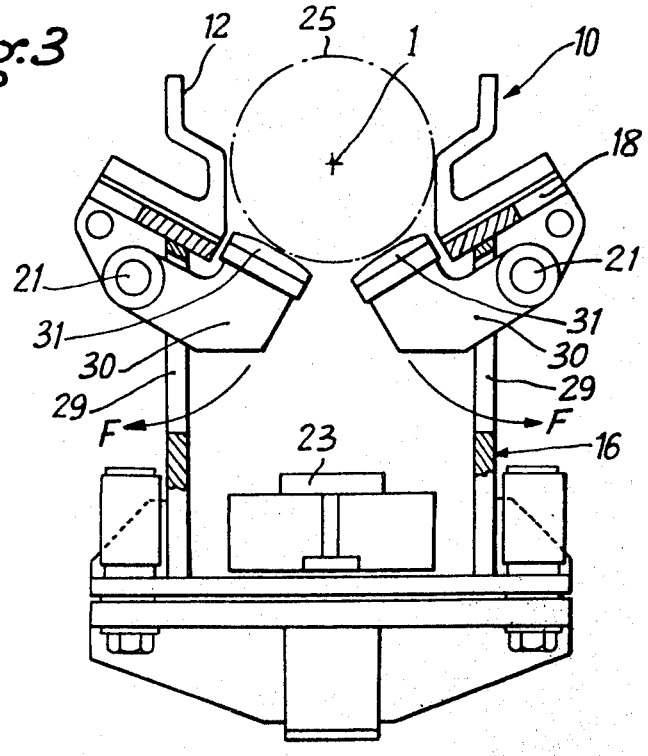
FIG. 3 is a sectional view taken along the line III—III of FIG. 1.
Figure 4:
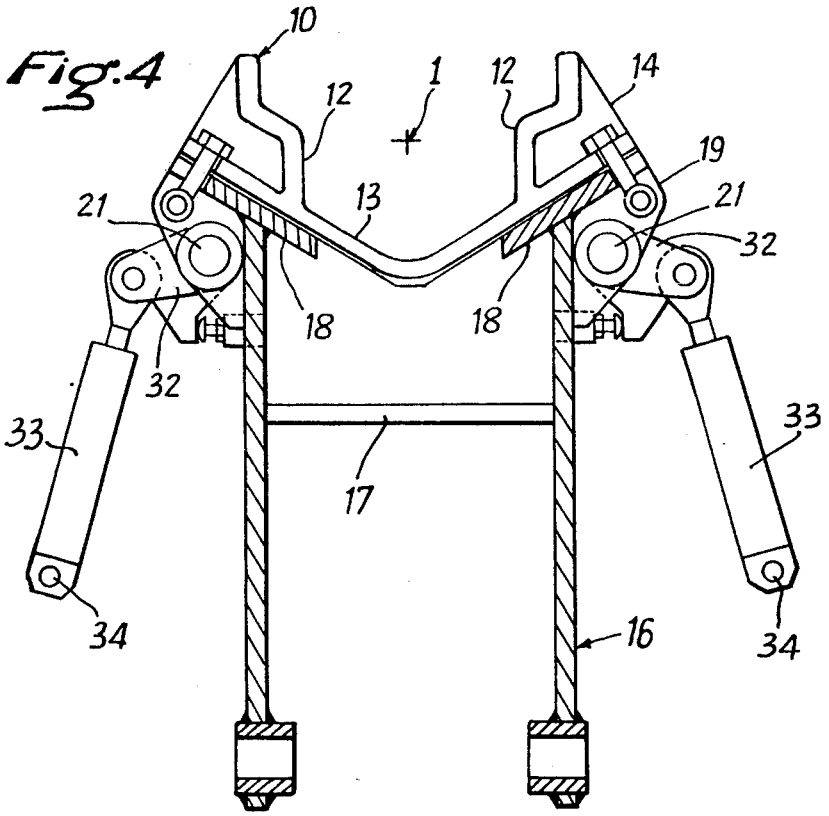
FIG. 4 is a sectional view taken along the line IV—IV of FIG. 1.

As seen on FIGS. 3 and 4 the part 10 of the feed trough has two sides 12 and its bottom 13 is V-shaped. Ribs 14 stiffen this part 10. The end 15 of the part 10 adjacent the rolls 2 and 3 has a champfered shape. As will be seen on FIG. 3 the bottom 13 of the member 10 is missing from the end 15 for a certain distance extending substantially toward the middle of the member 10, in other words the bottom 13 is absent except for the right half of the member 10 as seen in FIG. 1.

It will be seen that the member 10 is interchangeable and there is in fact available a set of members 10 having different widths between their walls 12 so as to adapt to the substantial difference in the diameter of the tubes being rolled. It will, however, be appreciated that a single member 10 is capable of guiding tubular members which vary only slightly in diameter.

A member 10 is attached by suitable bolts to a frame 16 consisting principally of two parallel vertical plates connected by internal cross bars 17. The two plates of the frame 16 carry inclined supports 18 for carrying the member 10. The external ribs 19 of the frame 16 support horizontal or nearly horizontal bearings 20 in which two substantially horizontal and preferably parallel shafts 21 turn. These shafts are positioned on opposite sides of the frame 16. A transverse horizontal shaft 22 is supported at the lower part of the frame 16 and the member 23 is pivotally connected to this shaft and tapered on the side of the roll 3. This member 23, having a T-shaped section is followed by a stationary member 24 which constitutes an extension thereof. The regulating means such as a screw jack 38 make it possible to tilt the member 23 more or less about the transverse axis 22 in dependence upon the diameter of the neck of the rolls 2 and 3. The right end of the member 24 leads to the level of the lower groove in the barrel positioned in the casing 7. It will be understood that the members 23 and 24 form an inclined chute which leaves the plug free after its passage toward the lower groove of the barrel as disclosed in French Pat. No. 1,564,381.

Figure 5:
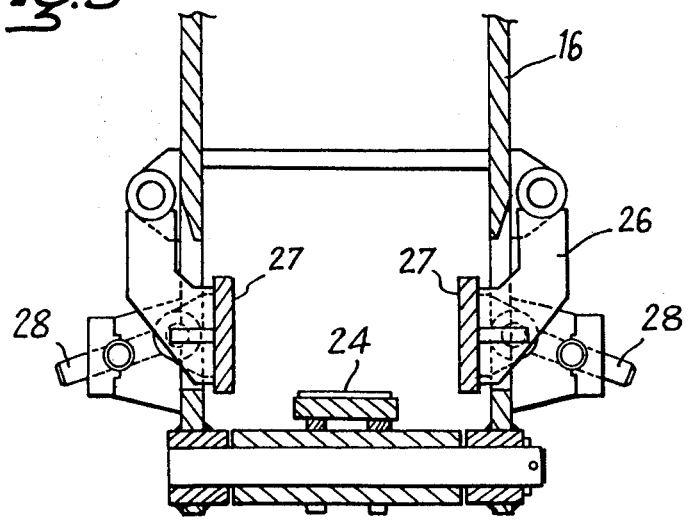
FIG. 5 is a sectional view taken along the line V—V of FIG. 1.

In order to insure transverse guiding of the plug when it slides on the inclined part of the chute 24 it will be seen from FIGS. 1 and 5 that the frame 16 has openings through which two pivotal arms 26 project from each side to support the shutters 27 inside the frame 16. By adjusting the position of the shutters 27 by means such as the adjusting screws 28 the width of the passage defined by the members 23, 24 and the shutters 27 may be regulated.

Each of the shafts 21 carries two levers 30 which generally define right angles and extend into the frame 1 through vertical openings 29 formed in the plates of the frame 16. The two levers 30 of each of the shafts 21 each support a shutter 31, which shutter is elongated in a horizontal direction. The length of a shutter 31 is slightly less than half the length of the frame 16. It follows that when the shutters 31 are in their first upper position represented on FIG. 3, they form a sort of extension of the V-shaped bottom 13 up to a point near the pair of rolls 2 and 3.

It will also be seen on FIG. 3 that a plug 25 shown in broken lines is guided by the shutters 31. The two shafts 21 also carry at the side of the barrel two small levers 32 at the free end of which are respectively pivotally connected the piston rods of two fluid pressure jacks 33, the other ends of which are pivotally connected at 34 to a member fixed to the frame 16.

By actuating the hydraulic cylinders 33 the rods of the cylinders are forced outwardly so that the levers 30 mounted on the shafts 21 pivot in the directions of the arrows F (FIG. 3). During this pivotal movement the shutters 30 first begin to descend little by little, separating from each other to fold back against the two walls of the frame 16. It will be appreciated that the plug 25 descends while supported by the shutters 30 and remains horizontal until the space between these shutters which increases as they pivot becomes greater than the diameter of the plug 25. At this moment the plug 25 falls and swings on the member 23, on which it slides in the direction of the lower groove in the barrel.

The operation is as follows:

The tubular members to be rolled, fed in by a conventional pusher member at the right side of FIG. 1, enter the feed trough 9 and then a corresponding groove in the barrel containing a plug 25. The tubular member, continuing to advance toward the rolls, pushes the plug 25 before it, as the plug is guided successively by the bottom 13 of the member 10 and then over the shutters 30 in their upper position until it passes between the two rolls 2 and 3 where it is axially blocked by a conventional plug bar not shown.

From this moment the tubular body which has advanced the plug passes around the plug between the rolls 2 and 3 and is thereby rolled. Of course, throughout the rolling, the plug is urged forward by the advance of the tubular body which passes thereover in a direction approaching the left of the figure against the plug bar. When the tubular body has passed completely over the plug the latter is liberated and again comes to rest on the shutters 30 which remain in their upper position. At this time the cylinders 33 are actuated and the shutters begin to descend so that the plug descends with them, and when the shutters are completely separated the plug drops onto the member 23. Then by means of the member 24 and the shutters 27 it is returned to the lower groove in the barrel diametrically opposed to the upper groove from which it was driven by the tubular body.

At this moment the tubular body is brought back and, after passing through the feed trough in the opposite direction, is returned toward the pusher. The barrel is then actuated to rotate through a quarter of a revolution to position a second mandrel adapted to a second pass of the tubular body. The tubular body is then again driven toward the cylinders and drives out the second plug which, after the second pass, is removed in the same way as the first plug was. The rolled tube is removed after the second pass and a new tubular member to be rolled arrives in the feed trough, after which the barrel is rotated through another quarter turn, which brings the first plug back into position. It will be readily understood that various differences may exist between the shapes described. Thus the movement of the shutters instead of being a pivotal movement about the shafts 21 may be a translational movement, for instance an oblique translational movement toward the bottom to progressively separate the shutters as they descend.

In another embodiment the shutters may be eliminated and the member 23 may be disconnected from the shaft 22 and supported by a mechanism which causes it to perform a complex pivotal movement bringing it from the position of FIG. 1 in which it forms the lower part of the discharge chute to a horizontal position in which it forms an elongation of the bottom 13 of the member 10.

Figure 6:
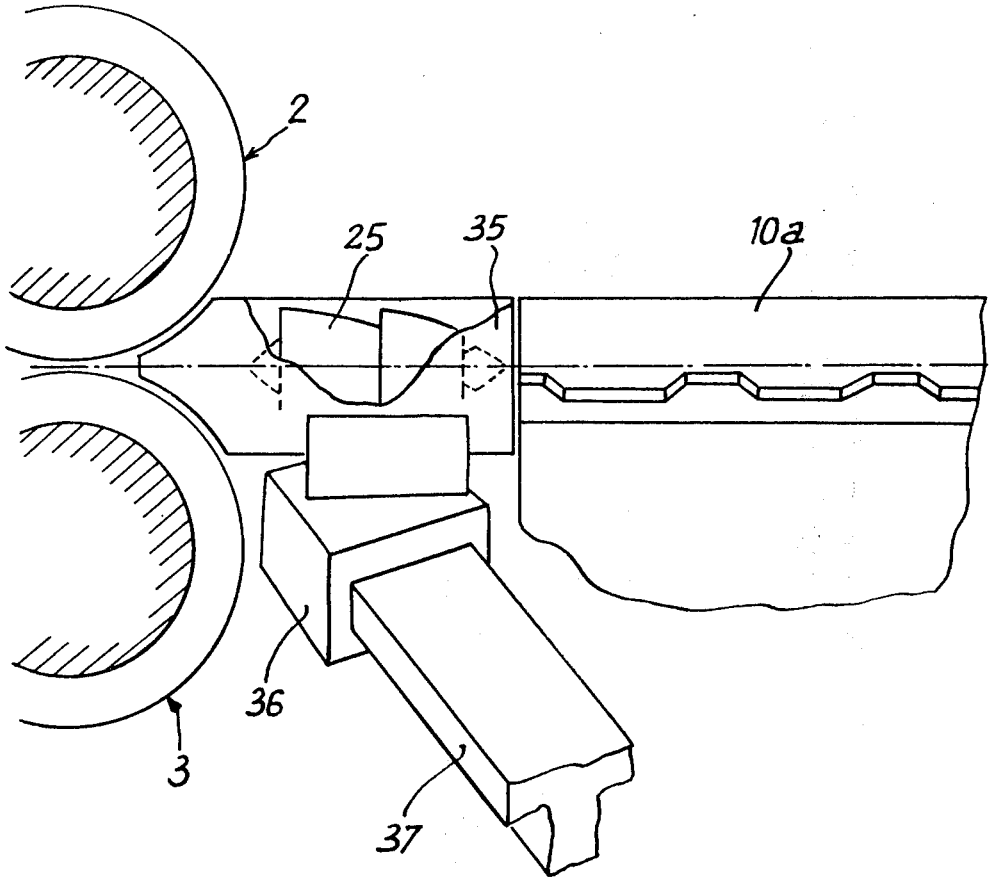
FIG. 6 is a schematic view of another embodiment of the invention.

Referring now to FIG. 6, in this embodiment the barrel with its casing is eliminated. The feed trough **10*a* has a V-shape analogous to the one shown in FIG. 4. This trough is completely eliminated at both its bottom and at its sides for a distance from the rolls 2 and 3 greater than the length of a plug 25. The guide member 35 consists of a sectional member which is internally V-shaped and in which the plug 25 rests. The V-shaped member thus constitutes an extension of the feed trough 10*a*. The two sides of this member are tapered adjacent the cylinders 2 and 3 so as to insure the guiding of the plug as long as possible. The member 35 is itself mounted on a carriage 36 sliding on a slide 37 which is downwardly inclined and extends away from the vertical rolling plane and from the lower roller 3. In its lower position (not shown) this member may cooperate with means for bringing in and removing the plug. In a variation it is possible to provide two members 35** mounted on slides which are symmetrically positioned about a vertical plane so as to alternately present a plug, which may then remain constantly supported by their corresponding guide members.

It will of course be appreciated that the invention which has just been described has been given purely by way of illustration and example and may be modified as to detail without thereby departing from the basic principles of the invention.

What is claimed is:

1. In a device for mechanically changing plugs in tube rolling mills having opposed rolls for rolling an article advancing along a rolling axis, said device comprising:

a feed trough for tubular bodies to be rolled positioned in alignment with the rolling axis and the end of which adjacent the mill rolls is separated therefrom by a distance greater than the length of plug, a plug bar projecting into the gap between the mill rolls from the side opposite said feed trough, means for periodically locating a plug at the start of each pass in alignment with the rolling axis so that the plug may be brought into abutment against said plug bar by a tubular body traveling in the feed trough, the improvement which comprises movable guide means movable between a first position aligned with the feed trough between the mill rolls and the end of the feed trough and a second position spaced from the axis of the feed trough, and in which said movable guide means comprises two shutters capable of moving toward and away from each other to form when moved toward each other a substantially V-shaped channel.

2. Device as claimed in claim 1 in which said shutters are pivotally mounted to rotate about respective axes.

3. Device as claimed in claim 1 which comprises means for symmetrically displacing said shutters on opposite sides of the rolling axis.

4. Device as claimed in claim 1 in which the means for locating the plug comprises a grooved barrel rotatable about an inclined axis to successively present plugs aligned with the rolling axis and retrieve plugs discharged through an inclined chute the upper part of which is positioned beneath the space separating the rolling axis from the mill rolls, the barrel and mill rolls being associated with a frame carrying at its upper end said feed trough and in its upper part near the cylinders two parallel shaft supporting levers extending toward the inside of the frame and carrying said two shutters.

5. Device as claimed in claim 4 in which said shafts are rotated by small levers pivotally connected to the end of fluid pressure exerting means.

6. Device as claimed in claim 4 in which the two shafts are positioned outside the frame which is provided with openings for admitting the levers supporting the shutters.

7. Device as claimed in claim 6 in which the inclined chute comprises a first member capable of pivoting about a horizontal axis and means for regulating the pivotal position of said member.

8. Device as claimed in claim 7 in which said chute comprises two inclined shutters mounted on pivotal arms on the frame, and means to adjust the spacing of said shutters which determine the width of the channel.

* * * * *

UNITED STATES PATENT AND TRADEMARK OFFICE

CERTIFICATE OF CORRECTION

PATENT NO. : 3,955,392

DATED : May 11, 1976

INVENTOR(S) : MAURICE PREVOT

It is certified that error appears in the above-identified patent and that said Letters Patent are hereby corrected as shown below:

[30] Foreign Application Priority Data

January 10, 1974.....France..... 74-00817

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*